United States Patent [19]

Semmerling

[11] 3,998,419

[45] Dec. 21, 1976

[54] SWIVEL TYPE HANGER BRACKET

[75] Inventor: Ralph P. Semmerling, Chicago, Ill.

[73] Assignee: United States Gypsum Company, Chicago, Ill.

[22] Filed: Nov. 3, 1975

[21] Appl. No.: 628,457

[52] U.S. Cl. ..... 248/323; 52/484

[51] Int. Cl.[2] ..... E04B 5/54; E04G 17/18

[58] Field of Search ..... 248/323, 327, 317; 52/484, 485

[56] References Cited

UNITED STATES PATENTS

| | | | |
|---|---|---|---|
| 3,558,091 | 1/1971 | Bush | 52/484 |

FOREIGN PATENTS OR APPLICATIONS

| | | | |
|---|---|---|---|
| 87,316 | 11/1955 | Denmark | 52/484 |
| 1,170,600 | 5/1964 | Germany | 52/484 |
| 283,047 | 1/1965 | Netherlands | 52/484 |
| 237,862 | 5/1964 | Switzerland | 52/484 |

*Primary Examiner*—J. Franklin Foss
*Attorney, Agent, or Firm*—Donnie Rudd; Samuel Kurlandsky; Robert H. Robinson

[57] ABSTRACT

An apparatus is disclosed for use in suspended ceilings. The apparatus is useful in leveling suspended ceilings while concurrently attaching them to supporting structures. The apparatus has an L-shaped connection piece having at least one opening in the base thereof, a swivel flange having at least one opening therein and partially enclosed at the bottom thereof by a clip for spacing apart an inverted-T runner and a flange while attaching the flange to the inverted-T runner, and a connector connecting the connection piece and flange through an opening therein. The connection piece and flange can be adjusted through the connector in order to adjust the location of a ceiling suspended by the inverted-T runner.

1 Claim, 14 Drawing Figures

SWIVEL TYPE HANGER BRACKET

BACKGROUND OF THE INVENTION

1. Field of the Invention

This invention relates to an apparatus for concurrently leveling an attaching suspended ceilings to supporting structures.

2. Description of the Prior Art

Suspended ceilings are common in the building industry. Such ceilings normally include parallel runner bars supported from hangers of adjustable length which are in turn attached in some way to the ceiling joists. The location of the joists varies significantly throughout a single ceiling in order to accommodate other design features such as placement of utilities. Even though the ceiling joist may vary significantly in location, it is desirable, for purposes of appearance, to have the suspended ceiling lie in a single plane rather than follow the joist variations. In order to accomplish this result, it is important to devise a system for accommodating the irregularities in location of the joists, and regardless of the irregularities, to provide a runner system which has a suspended ceiling lying in a single plane.

Many different systems have been devised for attaching suspended ceiling runners to ceiling joists. Perhaps the earliest and most common method of attaching the runners was a wire attached to the joist and passed through a hole in the runner and then appropriately bent to adjust the runner to the desired height. This system, however, was not a rigid construction and slight movements of the runner resulting from the non-rigid construction rendered the system undesirable. One improvement on this prior system is shown in U.S. Pat. No. 3,032,833. This design makes use of a wire attached to the joist or other portion of the ceiling, which then passes through a hole in an L-shaped support. A bolt passes through the bottom of the L-shaped support, and the bolt has a hook on its end for insertion into the runner. This system, however, still does not provide a rigid system, and, furthermore, requires that the holes in the runner exactly accommodate the suspended wire in order to provide attachment.

Substitution of the rigid bolts for the previously used suspending wires is now common and is further illustrated in U.S. Pat. No. 3,708,941. In this patent, however, the rigid bolt is attached to a clip which is then attached to the ceiling runner. This system, however, is not completely rigid and lacks adaptability in that the attachment to the joist is either restricted or else a multiplicity of different attachment devices must be used in order to give the desired adaptability. This is undesirable in that it creates the need for many different parts rather than making use of a single attachment for all different ceiling joist configurations.

In Australian Pat. No. 204,140, rigid hangers are suspended from the joists and then connected to inverted-T runners with the advantage that the suspended hangers are interconnected by stabilizers above the runner in order to provide a rigid system. This design, however, lacks adaptability in that it only provides for one specific type of attachment on the lower side of a ceiling joist. If utilities or the like prevent this attachment at an exact location, then extensive design alterations must be made in order to accommodate the system. In French Pat. No. 1,181,986, an L-shaped member is attached to the lower side of a ceiling joint and the projecting portion of the L-shaped attachment device is attached to an inverted-T runner. Slots are provided in the L-shaped member in order to adjust the height of the inverted-T runner. This system, however lacks adaptability in that different sizes of L-shaped members must be used for significant variations in joist location, and, furthermore, the inverted-T runner must be designed with its connecting portion in a single plane or else the inverted-T runner will not have the bottom portion thereof lying in a plane parallel to the plane of the floor and, consequently, the ceiling suspended therefrom will be undesirable.

In Canadian Pat. No. 741,946, a bolt is attached to the ceiling joist in a manner which allows it to be adjusted up and down to change the height of the ceiling. The bottom of the bolt is attached to a clip for clipping onto an inverted-T runner. This system provides only one type of attachment to a joist on the underneath portion thereof, thereby severely limiting its adapability and, additionally, releasably secures the inverted-T runner in a design that falls far short of being a rigid system. Additionally, the ceiling tile must be cut away at its back edges in order to accomodate the T-runner clip, and this severely restricts the type of ceiling tile that may be suspended by the system.

In U.S.S.R. Pat. No. 259,729, a rigid support is attached to the ceiling joist and has good adaptability even though it requires a plurality of inner-connected pieces for adjustment thereof. The bottom portion of the suspension system, however, requires opposing hooks having a spring-like design for engagement in the upper portion of a very specific type of inverted-T runner. While this system has some adaptability for accommodating different locations of ceiling joists, it is severely restricted in that it will only accommodate one type of T-runner and is therefore not useful in a wide variety of ceiling systems. In French addition Patent No. 70,110, a bottom connection piece for suspension of a T-runner is illustrated in one of its more complex forms. While the system is adaptable with regard to adjustment of the height of the ceiling, the complexity and number of pieces severely limits the adaptability of the system.

In one further embodiment described in the prior art, U.S. Pat. No. 3,390,856 has a clip for attachment to the upper portion of an inverted-T runner and the clip is attached to a flange suspended from a ceiling joist. This system not only fails to provide for adaptability of the upper portion of the system which connects to the joist, but, in addition, requires a critically designed bulbous upper portion of the inverted-T in order to accommodate the clip. Such a requirement severely restricts the adaptability of the system.

In the new and novel attachment device of this invention, the upper portion, with its swivel nature, is highly adaptable and can be attached to any exposed face of a ceiling joist. Regardless of the location of the ceiling joist, the upper portion of the attachment device can be swiveled to readily accommodate it. The bottom portion of the attachment device has, as an integral portion thereof, an inverted-T runner which may be adjusted at any leveling position in order to accommodate any desired height of suspended ceiling tile. The combined teachings of all of the prior known systems do not result in an attachment device with the adaptability and utility shown in the present invention.

SUMMARY OF THE INVENTION

It is an object of this invention to provide an adjustable support for suspended ceilings permitting the ceiling height to be properly adjusted during construction.

It is an additional object of this invention to provide a new and novel suspended ceiling system.

The objects of this invention are accomplished by a swivel type hanger for use in suspending ceilings, said hanger comprising an L-shaped connection piece having at least one slot in a face thereof, a swivel flange having at least one slot therein and partially encircled at the bottom thereof by a clip for spacing apart an inverted-T runner and the swivel flange while attaching the swivel flange to the inverted-T runner, and a connector connecting the connection piece and flange through a slot therein, whereby the connection piece and flange can be adjusted through the connector in order to adjust the location of a ceiling suspended by the inverter-T runner. The attachment device of this invention has an upper portion and a lower portion. The upper portion is an L-shaped connection piece having a slot in a base thereof. Preferably the connection piece has a slot in both faces thereof. The slots serve a dual function. In the side portion, the slot can either serve as a conduit for connection of the upper piece to the lower piece of the system, or it can serve its function by concurrently attaching the two pieces together and attaching the two pieces to a supporting structure. The upper face of the L-shaped piece preferably has slots therein for attachment to supporting structures. These slots can readily accommodate a bolt or some other such device for attachment to the supporting structure. When the upper piece is rotated or swiveled about the lower piece, the upper section, with the slots therein, becomes a side section for attachment to a stud or joist which runs perpendicular to a supporting member to which the device would be attached by attaching to the supporting structure through the side piece. The lower portion of the hanger is a swivel flange which can rotate about a connection device as desired. The swivel flange has at least one slot therein for attachment to the upper piece, and the swivel flange is at least partially encircled at the bottom thereof by a clip which is useful in spacing apart an inverted-T runner and the flange while attaching the flange to the inverter-T runner. A connector is utilized for connecting the connection piece and flange through a slot in each of the pieces. The extreme versatility of the attachment device enables an attachment along the side of the joist, underneath the joist, through a covering material into the joist, through simply covering material, or through almost any other type of configuration of ceiling joist system. The attachment device is particularly adaptable to inverted-T runners in which the top portion, after inversion, is enlarged to provide additional strength to the T-runner. In such a design of a T-runner, the clip that is used with the attachment device enables the T-runner to be attached in the alignment necessary to provide a ceiling along a proper plane.

BRIEF DESCRIPTION OF THE DRAWINGS

This invention may be more fully described and defined by the embodiment shown in the attached drawings wherein.

DESCRIPTION OF THE PREFERRED EMBODIMENTS

Figure 1:
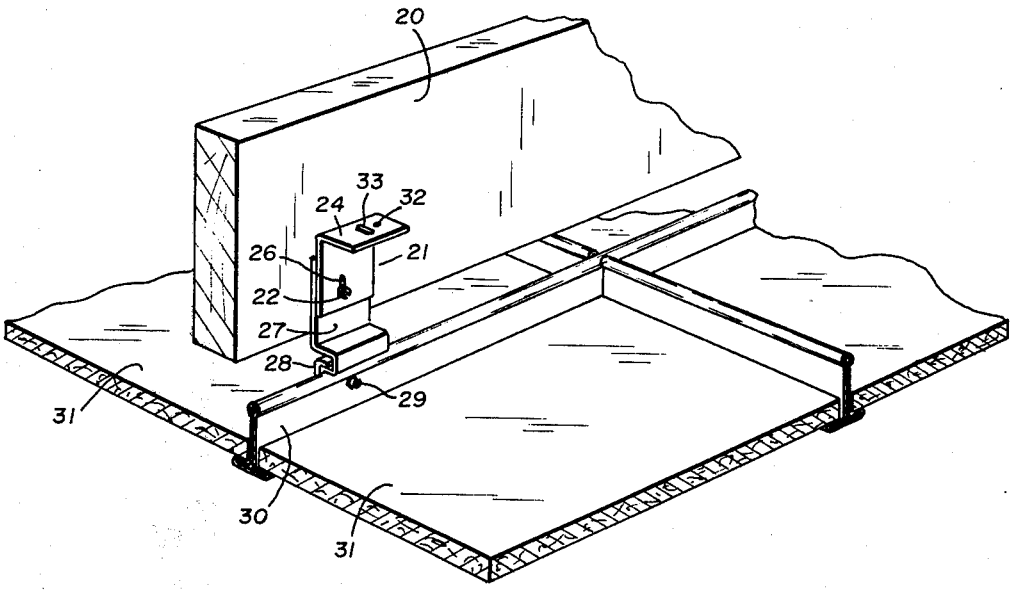
FIG. 1 is a perspective view of assembled ceiling utilizing the attachment device of this invention.
Figure 4:
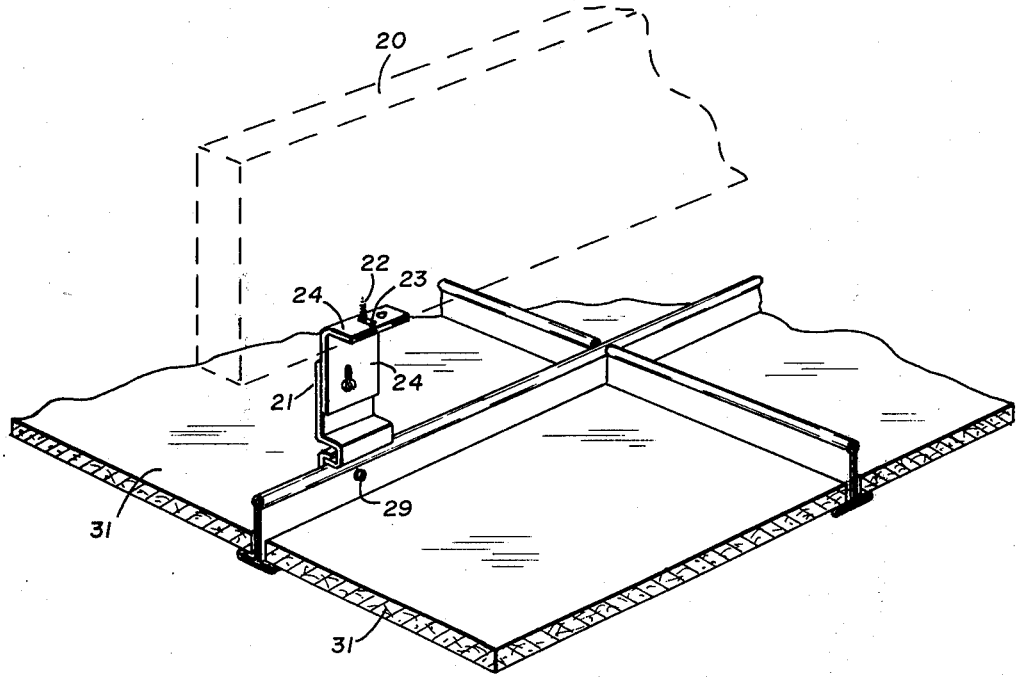
FIG. 4 is a perspective view of the attachment device of this invention showing a joist, in phantom, and showing the suspended ceiling making use of the attachment device.
Figure 5:
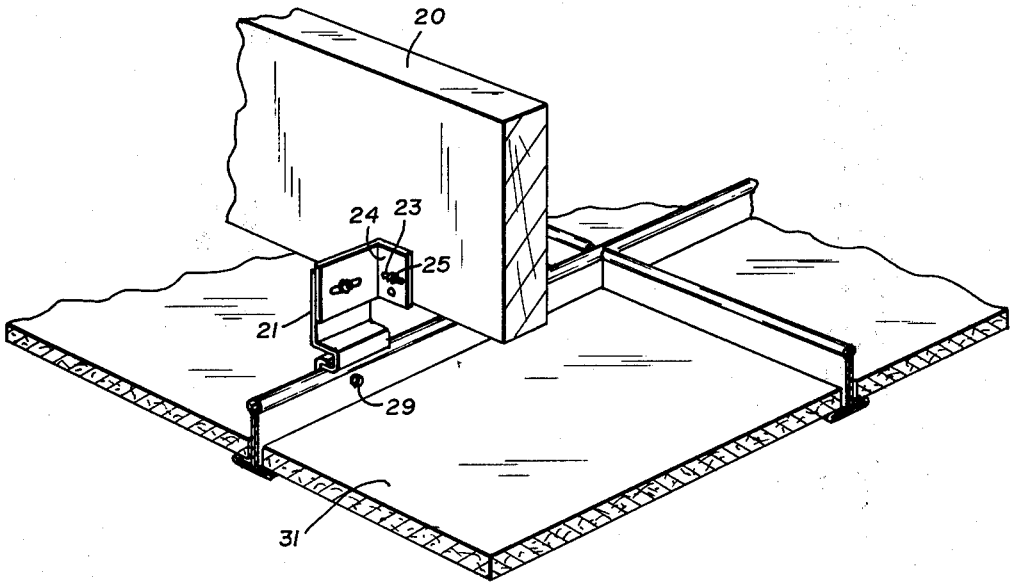
FIG. 5 is a perspective view of an assembled suspended ceiling showing the attachment device of this invention with the upper piece being rotated in order to enable the inverted-T runner to be mounted perpendicular to the joist.

The attachment device of this invention is more fully described by reference to the embodiments illustrated in the attached drawings wherein a ceiling joist 20 is the basic supporting structure for the ceiling. An attachment device 21 is attached to the joist. In FIG. 1, the attachment is by a screw 22 directly into the jacket through a hole in the attachment device. In FIG. 4 the attachment is made directly into the bottom side of the joist by utilizing screw 22 through hole 23 and L-shaped connection piece 24 of the attachment device. In FIG. 5, the L-shaped connection piece 24 is rotated 90 degrees enabling attachment through hole 23 into the side of the joist by use of screw 25. In each embodiment shown, the connection to the supporting joist is made through L-shaped connection piece 24 and may be through either the base thereof or through the top portion thereof with the L-shaped connection piece either having the top thereof fall in a plane parallel to the plane of the ceiling or else the L-shaped connection piece rotated, as necessary, including rotation a full 90° thereby causing the L-shaped connection piece to have the portion attached to the joist fall in a plane perpendicular to the plane of the ceiling. Such a rotation enables attachment of the attachment device in any desired manner or configuration for the purpose of adjusting the height of the ceiling suspended thereby.

FIG. 1 shows the joist 20 with the clip 21 having the L-shaped connection piece directed in the upward direction and being attached by bolt 22 through slot 26 through the swivel flange 27 into the joist 20. A clip 28 for spacing apart an inverted-T runner and the flange, while attaching the flange to the T-runner, partially encircles the bottom of the flange for proper adjustment. A bolt 29 connects the bottom of the flange (with the spacing clip) to the inverted-T runner 30 which in turn supports ceiling tile 31.

Figure 2:
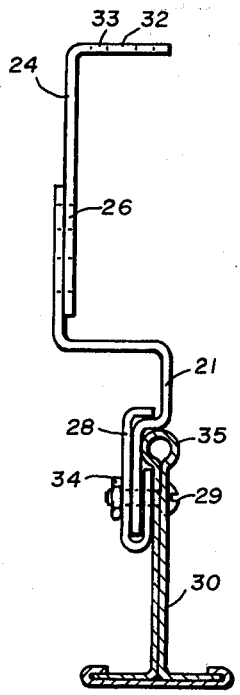
FIG. 2 is an end view of the attachment device of this invention.

FIG. 2 illustrates an end view of the attachment device of this invention showing slots 32 and 33 in the L-shaped connection piece and showng clip 28 partially encircling the bottom portion of the flange and with bolt 29 with nut 34 attached thereto clamping the inverted-T runner 30 to the bottom of the flange and being spaced apart therefrom by the clip. The inverted-T runner 30 has an enlarged portion 35 for strengthening the T-runner, and therefore, the clip is necessary in order to accommodate the spacing of the T-runner and the bottom of the flange to provide exact alignment of the T-runner.

Figure 3:
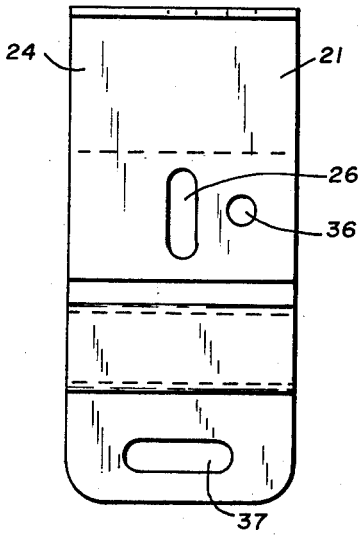
FIG. 3 is a side view of the attachment device of this invention.

FIG. 3 is a side view of the attachment device of this invention wherein end slot 26 is shown for accommodating the connection, and an additional slot 36 is shown for additional attachment for stability. A slot 37 is provided for attaching the bottom of the flange to the inverted-T runner.

Figure 6:
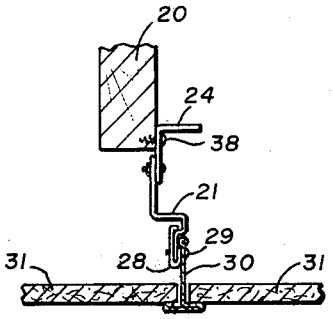
FIG. 6 is an end view of the installed attachment device of this invention showing the attachment to the side of a joist and showing an inverted-T runner used to suspend ceiling tiles.

FIG. 6 shows an end view of the attachment device of this invention with the L-shaped connection piece having a connection to the joist by screw 38. The clip 28 spaces apart the inverted-T runner 30 from the bottom of the flange, and the inverted-T runner supports ceiling tile 31.

Figure 7:
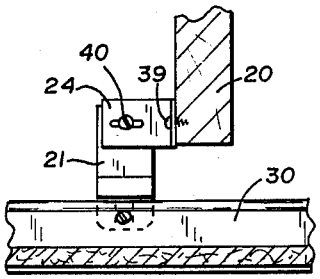
FIG. 7 is a side view of the attachment device of this invention showing its attachment to an inverted-T runner and showing the upper piece rotated 90° in order to show attachment of the attachment device with the T-runner being perpendicular to the joist.

FIG. 7 illustrates the L-shaped section of the attachment device in a relationship 90° rotated from that shown in FIG. 6 in order that the L-shaped portion thereof may have a flange which attaches through screw 39 to joist 20. Bolt 40 is used to attach the portions of the attachment device together and provide a swiveling effect. The bottom flange of the attachment device is used to support the inverted-T runner 30.

Figure 8:
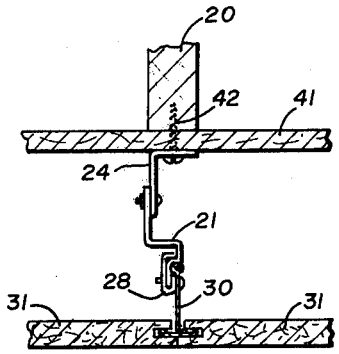
FIG. 8 is an end view of the attachment device of this invention showing the attachment device attached through a ceiling board into a joist.

FIG. 8 illustrates still another possible attachment utilizing the attachment device of this invention. In FIG. 8 a joist 20 has a ceiling 41 thereon, it being easier now to provide a new suspended ceiling than to tear down the old ceiling and replace it. The attachment device is attached through the ceiling into the joist by screw 42. The clip 28 spaces apart the bottom of the flange from the inverted-T runner 30 which in turn again supports ceiling tile 31.

Figure 9:
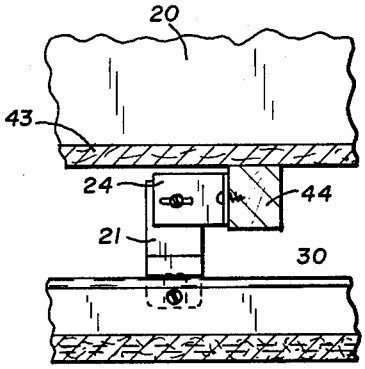
FIG. 9 is a side view of the attachment device of this invention showing the inverted-T runner perpendicular to a furring strip placed over an existing ceiling and showing the upper piece rotated 90° to accomplish this result.

FIG. 9 illustrates a type of ceiling similar to that shown in FIG. 8 and being a ceiling having a joist 20 already enclosed by ceiling 43. In this embodiment, however, furring strips 44 are placed on the ceiling and the attachment device has the L-shaped section rotated or swiveled 90 degrees in order to attach to the side of the furring strip. Again, the bottom flange of the attachment device is used to support inverted-T runners 30 which in turn support ceiling tile.

Figure 10:
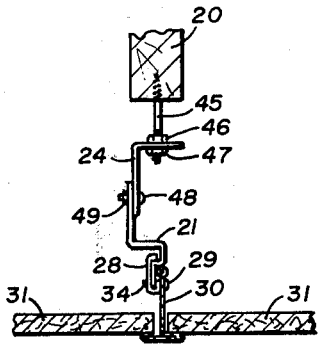
FIG. 10 is an end view of a ceiling using the attachment device of this invention and being supported from a wood joist by a bolt screwed into the joist and having nuts thereon for adjustment of the attachment device.

FIG. 10 illustrates an end view of the attachment device of this invention wherein joist 20 has a bolt 45 attached thereto. The bolt has two nuts 46 and 47 placed thereon with the nuts and bolts screwed together to lock the upper L-shaped section of the attachment device. This type of attachment, depending upon the length of the bolt 45 and the method by which it is screwed into the joist, can readily accommodate any height of ceiling desired. Leveling is very easily established with this type of device simply by adjusting bolts 46 and 47. Bolt 48 and nut 49 attach the parts of the attachment device of this invention together, and clip 28 spaces apart the bottom of the flange from the inverted-T runner 30 with bolt 29 and nut 34 attaching the bottom of the flange to the T-runner through the clip. The entire unit then supports ceiling tile 31.

Figure 11:
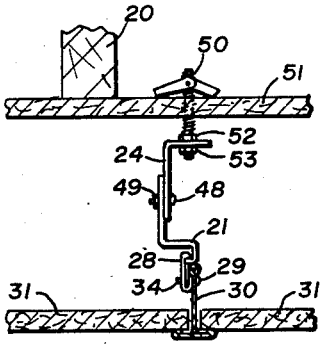
FIG. 11 is an end view of a ceiling using the attachment device of this invention with the attachment device supported by a toggle bolt having adjustable bolts on the suspended end thereof for adjusting the height of the attachment device.

FIG. 11 shows a similar attachment with a toggle bolt 50 being attached through ceiling 51 which is already in place. The toggle bolt 50 has nuts 52 and 53 which can readily be used to adjust the height of the ceiling and level it to any desired configuration. Bolt 48 and nut 49 attach the two parts of the attachment device together and clip 28 spaces the bottom of the flange apart from inverted-T runner 30 with bolt 29 and nut 34 attaching the portions thereof together to enable the inverted-T runner to support ceiling tile 31 in a suspended ceiling system.

Figure 12:
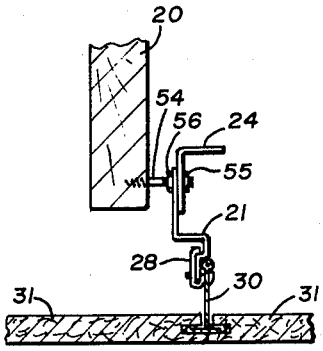
FIG. 12 is an end view of a suspended ceiling using the attachment device of this invention and showing the attachment by use of a bolt screwed into the side of the wooden joist and having nuts thereon for lateral adjustment of the location of the attachment device.

FIG. 12 illustrates an end view of an attachment device similar to that shown in FIG. 10, however, the attachment device is attached to the side of joist 20 by bolt 54 with nuts 55 and 56 thereon to control the lateral movement of the attachment device. While this particular type of configuration has a limited advantage in adjusting the upward movement of a ceiling, it does not provide a system for placing the T-runners in lateral alignment where the joist is not in the desired location. Again, clip 28 spaces apart the bottom of the flange and is connected to inverted-T runner 30 which in turn supports ceiling tile 31. In this embodiment, the ceiling tile is shown to be kerfed so as not to show the bottom of the inverted-T runner when the tiles are placed together.

Figure 13:
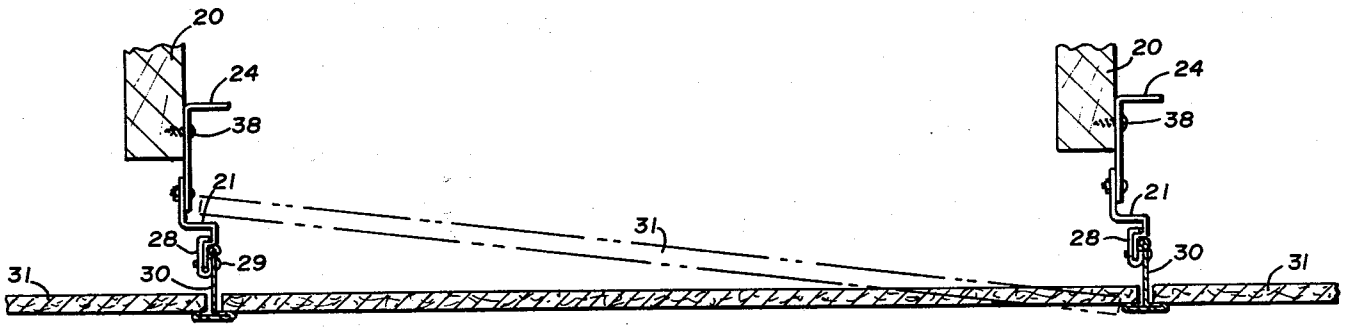
FIG. 13 is a side view of an assembled ceiling using the attachment device of this invention and showing, in phantom, the method of installation of the ceiling tile on top of an inverted-T runner supported by the attachment device of this invention.

FIG. 13 illustrates the method of laying the ceiling tiles 31 with the ceiling utilizing the attachment device of this invention. The attachment of the attachment device is the same as that shown in FIG. 6. The tiles are simply raised up into the attachment device, one side put in place, and the tile lowered within the attachment device.

Figure 14:
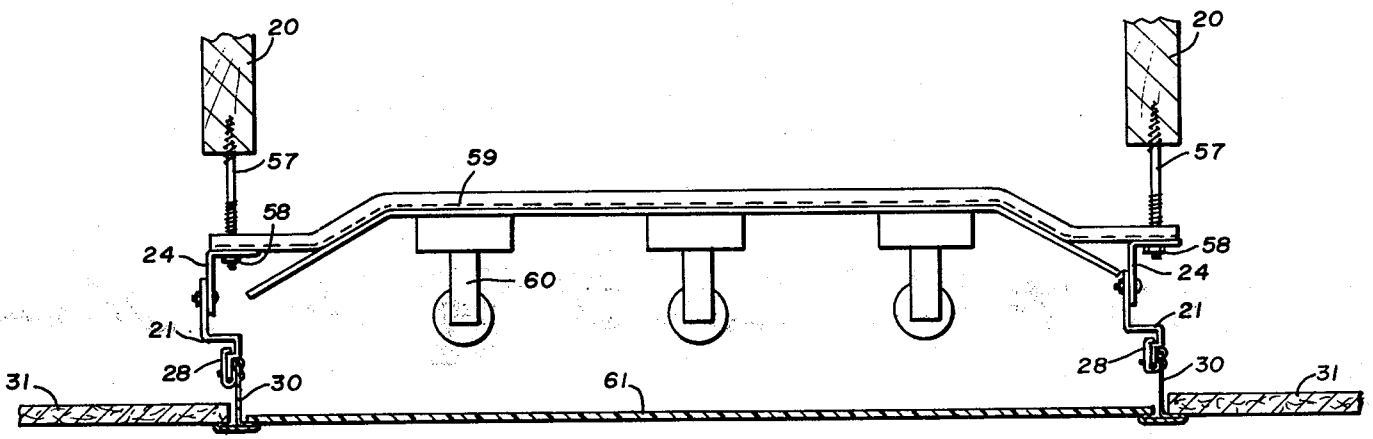
FIG. 14 is a side view of a suspended ceiling using the attachment device of this invention attached by use of adjustable bolts and further illustrating the installation of a suspended light system to the attachment device of this invention and having inverted-T runners supporting ceiling tile on one side and the translucent panel of the light fixture on the other side.

FIG. 14 illustrates another use of the attachment device of this invention. In this illustration, the joist 20 is attached to the attachment device through bolt 57. A nut 58 on the bottom of the L-shaped section of the attachment device supports the attachment device as well as reflector 59 of light fixture 60. Again, clips 28 space apart the bottom of the flange of the attachment device from inverted-T runner 30 which in turn supports ceiling 31 and translucent panel 61 enabling light to penetrate therethrough thereby lighting the room from the ceiling fixture.

The new and novel attachment of this invention is more versatile than anything previously shown. As illustrated in the drawings, the device may be attached either to the bottom or sides of the ceiling joist or may be attached through a first ceiling, or false ceiling, or may be attached to furring strips placed over a ceiling or over the joist. Additionally, the device may be attached simply to a previously installed ceiling by use of toggle bolts or the like. The ceiling, thus constructed, is highly adapable. Although not shown, the attachment device can easily incorporate systems which have air plenums recessed within the ceiling or which have other desirable systems recessed within the ceiling such as speakers and other type of air control systems. The type of attachment of the attachment device to the ceiling joist or previous ceiling is left to the desire of the person using the attachment device, and since the attachment device is so readily adaptable to any type of system, a multiplicity of alternatives is provided in order to accommodate any design feature of the ceiling joists. While all of the illustrated embodiments show wood joists with simple screw-type attachments to the joist, it must be understood that within the scope of this invention is included other types of joists, such as metal joists, in which the attachment device can be attached simply by screwing it thereto, or where any clip can be attached to the metal joist and the attachment device thereafter attached to the clip.

In installation of the ceilings made possible by the attachment device of this invention, the skilled craftsman can determine the desired location of the inverted-T runner and can install the attachment device with the T-runner in the desired location. Whether or not the T-runner is first installed to the attachment device, or the attachment device is first installed on the joist and then the T-runner is attached thereto, is a matter of discretion with the skilled craftsman who can readily determine the most convenient and economical way for installation of a system.

While only several forms and embodiments of the invention have been shown and described, other forms and embodiments within the spirit and scope of the invention will become apparent to those skilled in the art. Therefore, the forms and embodiments shown in the drawings are to be considered as merely setting forth the invention for illustrative purposes and are not intended to limit the scope of the invention herein described and shown.

It may thus be seen that the new and novel attachment device made possible by this invention is a highly adaptable attachment device that produces significant advantages over all attachment devices previously known and including a combination of all of the better features of previously known systems. The adaptability of the system is significantly greater than anything previously shown. Additionally, the system provides for a rigid ceiling which restricts movement of the T-runners and thereby provides a rigidity heretofore unknown in such systems. Additionally, the attachment device makes use of whatever type of connection is necessary in order to provide the proper spacing and location of the inverted-T runners. The adaptability of this system is such that regardless of the irregularities of the ceiling joist or previous ceiling, a proper ceiling can be provided lying in a uniform plane.

Having fully defined this new and unique invention, the following is claimed:

1. In combination, a supporting structure, a swivel type hanger, and inverted-T runner, and ceiling tile supported by the inverted-T runner, said swivel type hanger comprising an L-shaped connection piece having at least one slot in a face thereof, a swivel flange having at least one slot therein and partially encircled at the bottom thereof by a clip for spacing apart the inverted-T runner and flange while attaching the inverted-T runner to the flange through the clip, said swivel flange having an L-shaped portion, and a connector connecting the L-shaped connection piece and the swivel flange through a slot therein, said connection being adjustable and useful in adjusting the location of the ceiling tile supported by the inverted-T runner, said connector having an L-shaped upper portion for contacting the swivel flange near the L-shaped portion of the swivel flange, and said connector having a U-shaped bottom portion partially encircling the bottom of the swivel flange.

* * * * *